United States Patent [19]

Burrell

[11] 4,428,176

[45] Jan. 31, 1984

[54] REEL CLIP FEED SYSTEM

[75] Inventor: William E. Burrell, Inman, S.C.

[73] Assignee: W. R. Grace & Co., Cryovac Div., Duncan, S.C.

[21] Appl. No.: 292,086

[22] Filed: Aug. 12, 1981

[51] Int. Cl.[3] ..... B65B 51/05

[52] U.S. Cl. ..... 53/138 A; 29/243; 29/56; 198/746; 198/772

[58] Field of Search ..... 53/417, 138 A; 29/243.56, 243.57; 198/744, 745, 746, 772

[56] References Cited

U.S. PATENT DOCUMENTS

| | | | |
|---|---|---|---|
| 2,733,564 | 2/1956 | Russell | 53/138 A X |
| 3,163,972 | 1/1965 | Irwin | 53/138 A |
| 3,455,010 | 7/1969 | Busler | 53/138 A |

FOREIGN PATENT DOCUMENTS

| | | | |
|---|---|---|---|
| 2410332 | 9/1975 | Fed. Rep. of Germany | 53/138 A |

*Primary Examiner*—John Sipos

*Attorney, Agent, or Firm*—John J. Toney; William D. Lee, Jr.; Joseph P. Harps

[57] ABSTRACT

An improved method and apparatus for providing a large number of sealing clips inside a vacuum food bagging machine comprising a coil of clips containing many more clips than the prior art straight magazine. The apparatus includes a racheting positive feeder which draws the line of clips off a reel holding the coil, and through a turning means to orient the clips for feeding into the existing clipping station of the bagging machine. The feeder does not permit the line of clips to back away from the clipping station.

3 Claims, 10 Drawing Figures

REEL CLIP FEED SYSTEM

This invention relates to the art of sealing containers, and more in particular it pertains to a clip system for sealing bags or other packages or other packages in which food or other products are vacuum packed.

In this art, it is well known to provide packaging machines which comprise a plurality of vacuum chambers with means to clip the bags shut while the bag together with meat or other food product is in the vacuum chamber(s). In any supermarket one can see this sort of clip on packages of turkeys, large cuts of beef, and the like, which are vacuum packed.

A problem in this art has been the provision of a large quantity of the clips inside the vacuum chamber. The vacuum chamber is of limited size and no larger than necessary to accommodate the volume of food product to be packaged. In the commercial form of the machine shown in U.S. Pat. Nos. 3,832,824 and 3,928,938; which is the machine for which the present invention was specifically developed, a straight spring loaded magazine carrying 156 clips was provided. The clips are of the general shape of but considerably larger than the staples in an office desk stapler.

The 156 clips produce a problem, namely the need to stop production after that relatively small number of clips is used, to refill the clip magazine.

The present invention solves this problem by providing a flat coil of clips mounted on a reel whose diameter is less than the length of the previously used straight clip magazine. This reel can carry more than 550 clips, which is a nearly four fold improvement, or a cutting to about one quarter of the down-time required with the use of the prior art straight clip magazine.

Further, the invention provides means to turn the line of clips coming off the reel and to feed the line into the machine's clipping station in such a manner that the machine need not be modified, except for the addition of the turning and feeding mechanisms. The much more critical and complex clipping station is completely unchanged since the line of clips is delivered to the clipping station by the invention in exactly the same manner as they were heretofore delivered thereto by the prior art straight magazine.

The invention also permits the use of the existing pneumatic and electrical safety and interlock systems just as they were used with the prior art straight magazine. This makes substituting the present invention in place of the straight magazine a simple matter.

The invention also provides feeding means comprising an array of a ratchet feed finger and spring check fingers which provide improved operation by preventing any motion of the line of clips moving in any direction other than towards the clipping station. The prior straight magazine includes a spring loaded pusher block which solved this problem. The elimination of this block in the reel feed system of the invention produces advantages, but its function had to be replaced. If no such assurances were provided, then it might be possible for the remaining short end of the line of clips to not be fed into the clipping station, or to hang up in the clip feeder, or the like.

The above and other advantages of the invention will be pointed out or will become evident in the following detailed description and claims, and in the accompanying drawings also forming a part of the disclosure, in which:

Figure 6:
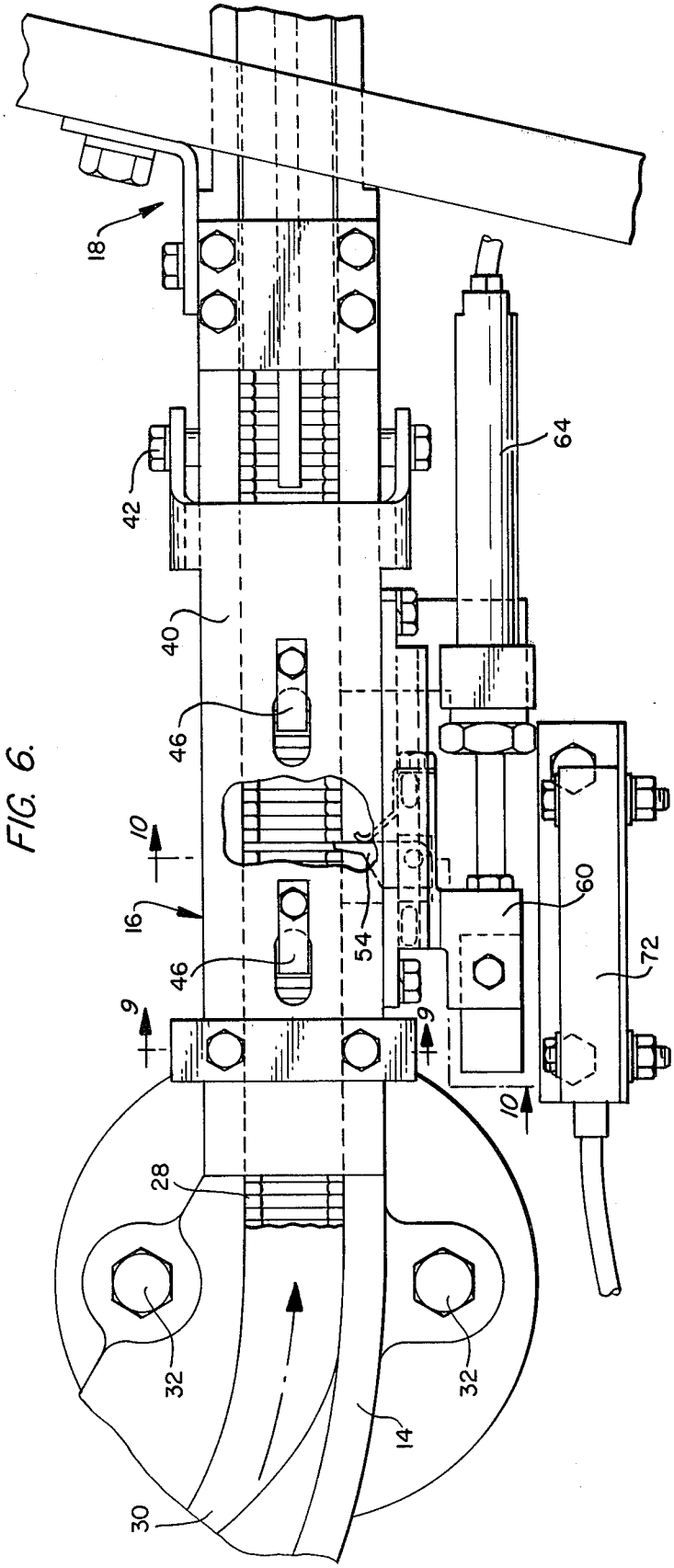
FIG. 6 is an enlarged plan view of the feeding station.
Figure 8:
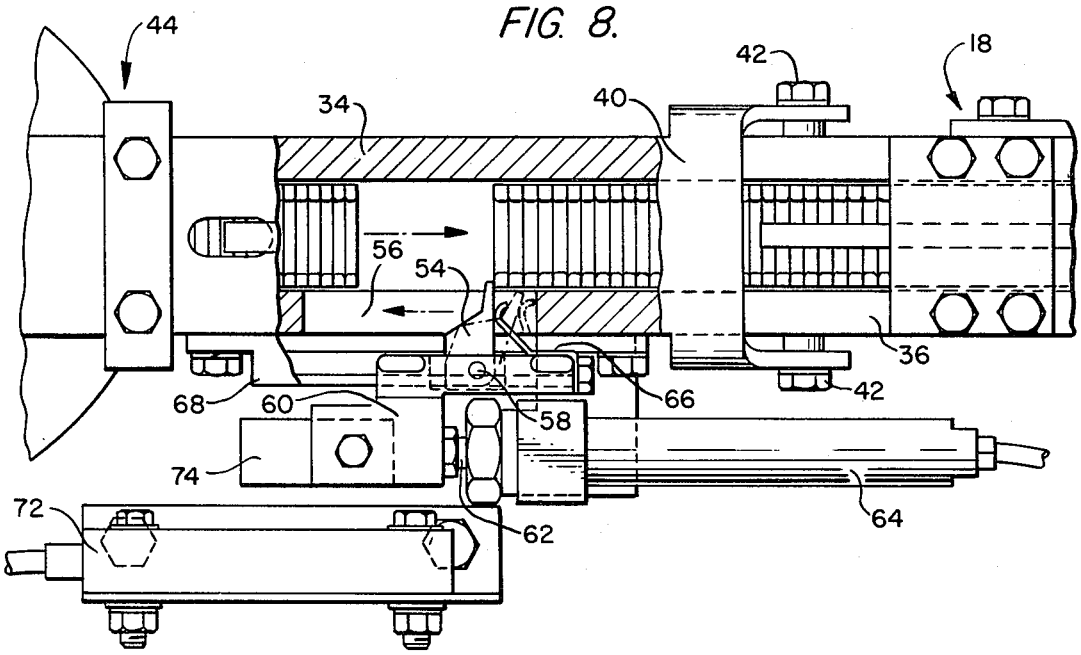
Figure 9:
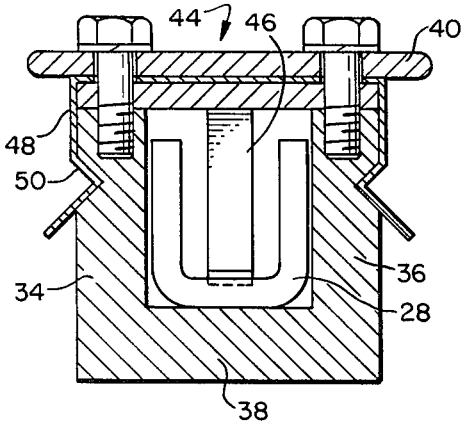
Figure 10:
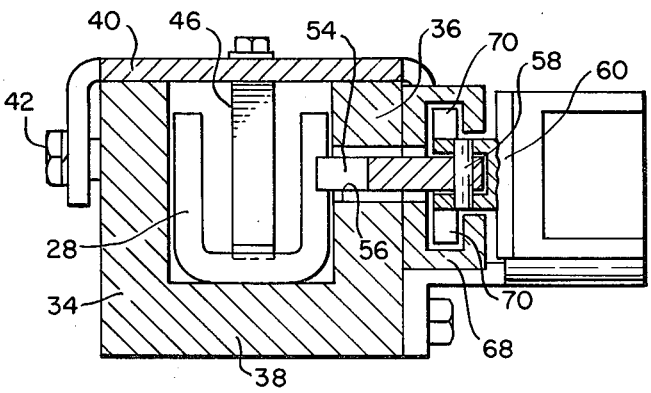

FIG. 8 is a view similar to FIG. 6 showing some parts broken away and illustrating the action of the ratchet feed finger; and FIGS. 9 and 10 are cross-sectional views taken on cutting lines 9—9 and 10—10 respectively of FIG. 6.

The present invention was developed specifically for use in the Cryovac model 8200 packaging machine for food products, particularly for fresh red meat. This machine is made and marketed by the Cryovac Division of W. R. Grace & Co., the assignee of the present invention, and the assignee of the two patents mentioned above which describe the model 8200 dual chamber vacuumizing machine in detail. To the extent needed to complete the teaching of this application, the teachings of said prior patents as well as of the technology of this known machine in general are hereby incorporated by reference as if here set forth in full.

Figure 1:
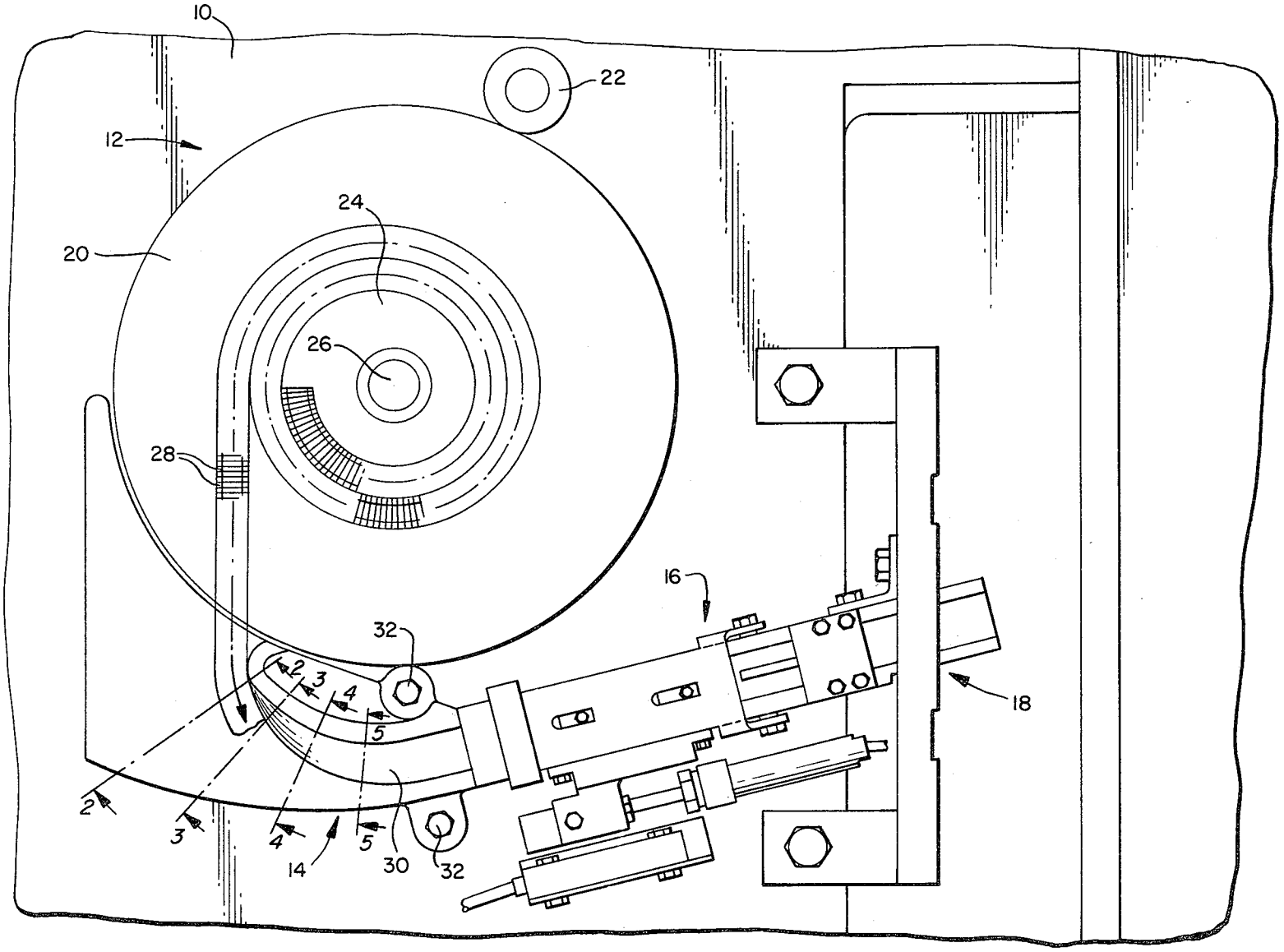
FIG. 1 is a plan view showing the invention in place on a food bag clipping machines.
Figure 5:
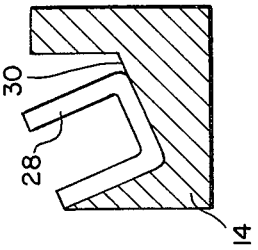
FIGS. 2, 3, 4 and 5 are a series of cross-sectional views taken on the same numbered cutting planes of FIG. 1 showing the manner in which the line of clips is turned from the reeled position to the feeding position.
Figure 4:
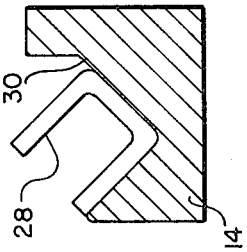
Figure 3:
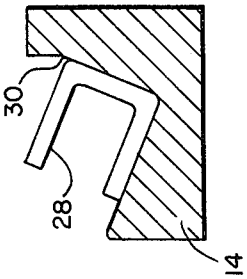

Referring now to FIG. 1, the machine with which the invention is used comprises a base plate 10 disposed generally horizontally on which there is mounted a reel clip 12, a clip turning station 14, a clip feeding station 16, and a bag clipper 18. The invention comprises the addition of parts 12, 14 and 16 in lieu of the straight magazine of the prior art. This spring loaded pusher straight magazine extended rearwardly from the clipper station 18 in place of the invention feeding station 16. The clipping mechanism 18 is used in the invention exactly as it was with the model 8200 machine heretofore.

It is an important advantage of the invention that no modifications to the clipping station 18 itself are required in order to include the invention comprising the parts 12, 14 and 16.

Figure 2:
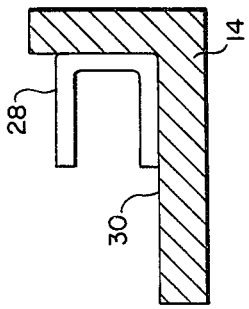

The reel station 12 comprises a base 20 preferably made of cardboard or other disposable material which cooperates with a guide roller 22. The assembly further includes a center support 24 fixed to the base 20. A pivot 26 is provided on which the reel comprising the parts 20 and 24 is freely rotatably mounted. The clips 28 are of generally "U" shaped configuration, and can best be seen in FIGS. 9 and 10. They are provided by the clip manufacturer in long chains or lines of any desired length held together by tape along their cross pieces which are positioned one next to the other. The continuous line of about 550 such clips is wound on the reel comprising the parts 20 and 24 with their cross pieces towards their radial inside of the reel, and with their legs pointed radially outwardly. This can best be seen in FIG. 2. The clips must be mounted in this manner, or there would be no other reasonable way of reeling up a line of clips, as will be clear to those skilled in these arts.

The invention operates with standard commercial clips, clip numbers Z-401, Z-411 and Z-421 manufactured by Tipper Tie, have been successfully used with the invention.

The clip line turning means 14 comprises a single cast piece of metal having a formed channel 30 therein, the shape of which can be seen by simultaneously viewing FIGS. 1, 2, 3, 4 and 5. The curvature and shape of the formed channel 30 is such as to turn the line of clips 90°. Their free ends are facing radially outwardly in a horizontal plane when in their flat reel, and they are turned so their free ends are pointing vertically upwardly with respect to base plate 10 at the exit end when the line of clips feed into clip feeder 16. Bolt means 32 or the like are provided to hold the one piece formed metal casting 14 in place on the plate 10. The final position on the line of clips upon leaving station 14 and entering station 16 can best be seen in FIG. 6.

The feeding station 16 comprises a "U" shaped enclosed trough of a size designed to snugly receive the line of clips 28 with their free ends pointing vertically upwardly, as shown. This trough comprises side walls 34 and 36 which extend from and are supported by a bottom wall 38. A lid member 40 is pivoted to the side walls by pivot means 42, and carries a spring closure 44 at its opposite end. On its under surface, the lid 40 carries a plurality of spring fingers 46 which extend down between the legs of the clips and bear against the clips' cross members. The fingers 46 are angled to point towards the clipping station 18. Thus, backward motion of the line of clips through the clipping station is resisted by this angle of the fingers 46. The fingers 46 are made of spring metal so that they easily permit forward motion in the direction in which they are slanted, but resist the undesirable backwards motion of the line of clips. This is best illustrated by comparing FIGS. 7, 9 and 10.

Figure 7:
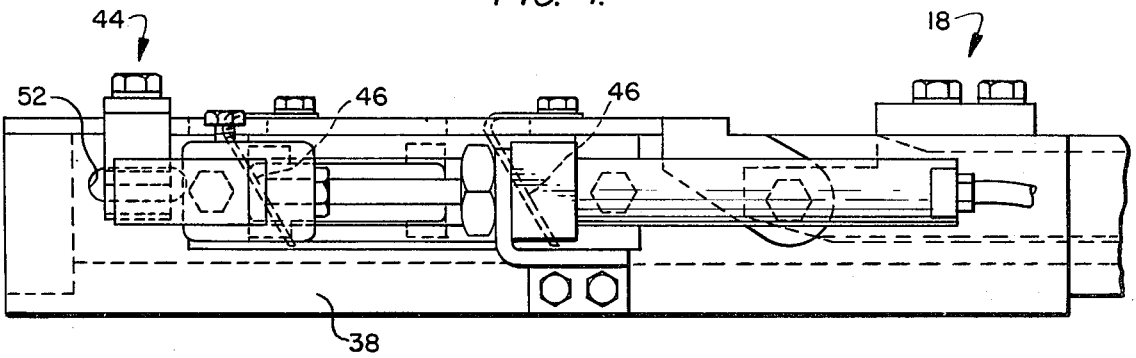
FIG. 7 is a side elevational view of the feeding station.

Locking spring closure 44 comprises a "U" shaped spring member 48 having inwardly extending detents 50 which cooperate with grooves 52 in the side walls 34 and 36, see FIGS. 7 and 9.

Thus, as is evident from the drawings and the above descriptions, the hold down means or lid 40 pivots on the pins 42 to allow adjusting, unjamming or whatever of the line of clips 28 in the feeding station, and, when in the down position as in FIG. 7, the spring fingers 46 prevent any backward motion away from the clipping station 18 of the line of clips.

Means are provided to positively feed the line of clips from the reel 12, around the turning station 14, through the feeding station 16 and into the clipping station 18. To this end, a feed finger 54 is provided. Finger 54 extends through a slot 56 formed in the side wall 36. Finger 54 is pivoted as at 58 to a feed finger carrier block 60 which is mounted on the piston 62 of an air cylinder 64. A flat spring 66 bears against clipping station side surface of the finger 54 to keep it normally in the solid line position of FIG. 8. Parts 54 through 60 are also shown in and can be better understood by viewing FIG. 10 together with FIG. 8.

Means are also provided to guide the motion of the feed finger 54. To this end, a "C" shaped guide rail 68 is secured to the outside of the wall 36 in overlaying register with the slot 56 therein. The carrier block 60 is provided with ears or extensions 70 which ride in the guide block 68 to control the motion of the feed finger 54.

In normal operation as shown in FIG. 6, the guide block 54 forces itself between two clips in the line, the piston 64 acting through the carrier block 60 urges the guide block to the right, and thus drives the line of clip to the right. Upon reaching the end of its stroke, other means described below are provided to sense that condition, and to drive the piston 62 of cylinder 64 all the way to the left. When this occurs the feed finger 54 pivots on its pin 58 and tilts to the dotted line position shown in FIG. 8, in effect ratcheting itself along the line of clips until it comes to the left hand extreme of its position, which is substantially as shown in FIG. 6. At that time, the beginning of rightward motion of cylinder 64 and the guide block 60 will again force the finger 54 into the line of clips to again reach the FIG. 6 clip driving position.

Means are provided to signal the end of the stroke of the piston so that it can be reciprocated to continue smoothly driving the line of clips forward. In the Model 8200 machine this is accomplished by a reed switch 72 which cooperates with a magnet carried by the pusher block in the spring loaded straight machine. The switch 72 is retained unchanged in the present invention, however, it is now operated by a magnet 74 mounted on the carrier block 60.

Similarly, modifications to the existing machinery are minimal in adapting the invention thereto in that the air cylinder 64, as well as the electrical circuitry associated with the reed switch 72, remain unchanged from the prior art machine. However, flow control means may be added into the air line feeding cylinder 64 so that the speed of this device can be made adjustable, to add greater versatility to the use of the invention.

While the invention has been described in detail above, it is to be understood that this detailed description is by way of example only, and the protection granted is to be limited only within the spirit of the invention and the scope of the following claims.

I claim:

1. In a packaging machine of the type wherein the package is clipped closed using "U" shaped clips each having a cross piece portion and a pair of legs extending from the ends of the cross piece substantially parallel to each other, each said clip being adapted to close and seal a package by having said legs folded over towards each other and over the opening of the package between the clip's cross piece and the folded over legs, said machine including a clipping station having means to accept said clips when they are in a predetermined orientation and to clip said packages closed thereat, said clips being arranged in a flat coil wherein the clips are joined to each other by tape means at their respective cross pieces so that their legs extend radially outwardly of the coil center, rotatable reel means on said machine for carrying said coil of clips, means to turn the line of clips unreeling from said reel from their coiled orientation to said predetermined orientation required at said clipping station, the improvement which comprises:

(a) enclosed track means having a cross-sectional area of a size and shape to snugly receive, hold, and guide said line of clips, said track means being defined by a "U" shaped channel having upright wall means and a bottom wall connecting said upright wall means, an opening at the top between said upright wall means and a lid member hinged to said channel at one longitudinal end thereof to cover said top opening of said channel, said line of clips progressing through said channel with their cross piece at the bottom thereof on said bottom wall;

(b) spring loaded rachet finger means extending through an opening in said upright wall means and into driving contact with said line of clips, (c) means to move said rachet finger means to and from along the line of motion of said clips through said track, said rachet finger means being mounted on said moving means so that said finger means drives said line of clips towards said clipping station and does not move said line of clips when said moving means moves said finger means away from said clipping station; and, (d) spring means mounted on said lid member above said track means and pointing towards said clipping station, whereby said line of clips moves easily towards said clipping station by sliding along said spring means and are restrained by contact with said spring means against motion away from said clipping station, and, (e) said spring means extending downwardly from said lid in the closed position of said lid between the legs of said clips to contact the top surfaces of said clip cross pieces.

2. The combination of claim 1, wherein said machine is a vacuum packaging machine for food, and wherein said reel, said turning means, said feeding means, and said clipping station are all located inside a vacuum chamber of said machine.

3. The combination of claim 1, wherein said line of clips progresses, seriatim off of said reel, through said turning means, through said track, and into said clipping station.

* * * * *